US012765587B2

(12) United States Patent
Shapiro

(10) Patent No.: US 12,765,587 B2
(45) Date of Patent: Oct. 20, 2026

(54) NICOTINE-FREE FORMULATIONS, DEVICES AND METHODS THEREOF FOR CESSATION OF SMOKING OR NICOTINE REPLACEMENT

(71) Applicant: Inhale Health LLC, Beverly Hills, CA (US)

(72) Inventor: Daniel Frederick Woolf Shapiro, Beverly Hills, CA (US)

(73) Assignee: Inhale Health, LLC, Los Angeles, CA (US)

( * ) Notice: Subject to any disclaimer, the term of this patent is extended or adjusted under 35 U.S.C. 154(b) by 572 days.

(21) Appl. No.: 18/044,563

(22) PCT Filed: Sep. 9, 2021

(86) PCT No.: PCT/US2021/049728

§ 371 (c)(1),
(2) Date: Mar. 8, 2023

(87) PCT Pub. No.: WO2022/056173

PCT Pub. Date: Mar. 17, 2022

(65) Prior Publication Data

US 2023/0363439 A1 Nov. 16, 2023

Related U.S. Application Data

(60) Provisional application No. 63/076,344, filed on Sep. 9, 2020.

(51) Int. Cl.

| | |
|---|---|
| ***A24B 15/167*** | (2020.01) |
| ***A24B 15/34*** | (2006.01) |
| ***A24F 40/10*** | (2020.01) |

(52) U.S. Cl.
CPC ..... *A24B 15/167* (2016.11); *A24B 15/34* (2013.01); *A24F 40/10* (2020.01)

(58) Field of Classification Search
CPC ..... A24B 15/167; A24F 40/10
See application file for complete search history.

(56) References Cited

U.S. PATENT DOCUMENTS

| | | | | |
|---|---|---|---|---|
| 2012/0128744 | A1 | 5/2012 | Sorge et al. | |
| 2012/0264776 | A1* | 10/2012 | Somani | A61P 11/14 514/289 |
| 2015/0257447 | A1 | 9/2015 | Sullivan | |
| 2015/0283070 | A1 | 10/2015 | Stenzler et al. | |
| 2017/0196898 | A1* | 7/2017 | Rosa | A61K 8/4926 |
| 2018/0338905 | A1 | 11/2018 | Shapiro et al. | |
| 2019/0054257 | A1 | 2/2019 | Cameron et al. | |
| 2019/0328040 | A1* | 10/2019 | Turbi | A61M 11/042 |
| 2021/0315261 | A1* | 10/2021 | Narasimhan | A24F 40/10 |

* cited by examiner

*Primary Examiner* — Eric Yaary
(74) *Attorney, Agent, or Firm* — Wilkinson Law Office; Clinton H. Wilkinson

(57) ABSTRACT

Formulations of nicotine-free compositions, methods of preparing and using same are disclosed. More particularly, the present disclosure relates to methods of preparing inhalable nicotine-free formulations, and to methods for treating a subject with a nicotine-free formulation for use in smoking cessation or nicotine replacement. Also disclosed is a system for controlling cravings and assisting a smoker in quitting smoking or nicotine use.

3 Claims, 5 Drawing Sheets

NICOTINE-FREE FORMULATIONS, DEVICES AND METHODS THEREOF FOR CESSATION OF SMOKING OR NICOTINE REPLACEMENT

CROSS-REFERENCE TO RELATED APPLICATION

This application is the US national phase under 35 U.S.C. § 371 of International Application No. PCT/US2021/049728, filed Sep. 9, 2021, which claims the benefit of U.S. Provisional Application No. 63/076,344, filed Sep. 9, 2020, the disclosure of each of which is hereby incorporated by reference in its entirety.

BACKGROUND OF THE INVENTION

Field of the Invention

The present disclosure provides nicotine-free compositions, formulations of aerosolized nicotine-free solutions and methods for use. More particularly, the present disclosure relates to nicotine-free compositions, methods of preparing inhalable nicotine-free formulations, and to systems, methods and kits for treating a subject with a nicotine-free formulation for use in nicotine replacement or cessation.

Description of the Related Art

Cigarette smoking and use of nicotine-containing products in general continues to be the leading cause of preventable disease and death in the United States. (US Department of Health and Human Services (HHS), CDC; 2014. https://www.cdc.gov/tobacco/data_statistics/sgr/50th-anniversary/index.htm). It is widely known that smoking cigarettes, exposure to cigarette smoke and use of nicotine harms almost every organ of the body, causing adverse health consequences, including heart disease, stroke and multiple types of cancer. (Id.)

Exposure to nicotine during childhood has been shown to cause addiction and harm the developing adolescent brain, and nearly all tobacco or nicotine-containing product use begins during youth and early adulthood. (US Dept. of HHS, CDC; 2014 and US Dept. of HHS, CDC; 2016. https://www.cdc.gov/tobacco/data_statistics/sg r/e-cigarettes/pdfs/2016_sgr_entire_report_508.pdf). Smoking of cigarettes by youth under the age of 18 in the U.S. had steadily declined over the past two decades. (US Dept. of HHS, CDC; 2014 and US Dept. of HHS, CDC; 2016). But the recent introduction of e-cigarette devices containing nicotine has led to e-cigarettes being the most commonly used nicotine-containing products by U.S. middle school and high school students. Since 2014, e-cigarettes have been the most commonly used product by both high school (20.8%; 3.05 million)) and middle school (4.9%; 570,000) students. (Gentzke, et al. 2019). In 2018, 27.1% of high school students (4.04 million) and 7.2% of middle school students (840,000) reported current use of one or more tobacco products. (Id.).

While the incidence of cigarette smoking had declined in adults to 14% in recent years, (Wang et al., 2017), numerous new tobacco or nicotine-containing products, including e-cigarettes, have entered the market in the United States. (US Dept. of HHS, CDC; 2016). With these new products, an estimated 49.1 million adults (19.7%) reported current use of any tobacco products, including traditional cigarettes (13.7%), cigars (3.9%), e-cigarettes (3.2%), smokeless tobacco (2.4%), and pipes (1.0%). (Wang et al., 2017). The significant increase in adult e-cigarette use (also known as "reduced risk tobacco products") from 2017 to 2018 is troubling as it is the first increase since a steady decline from 2014 to 2017. (Id.). While e-cigarettes have been touted as viable alternatives to combustible cigarette smoking, recent studies have shown that under certain circumstances, e-cigarettes can deliver nicotine levels that meet or exceed those commonly delivered by traditional cigarettes. (DeVito E E and S. Krishnan-Sarin, 2018). Moreover, flavorings, and in particular menthol, have been shown to be purposefully included by tobacco companies to increase the "palatability" of tobacco products and to increase addiction to nicotine products, whether in the form of traditional cigarettes or e-cigarettes, making it harder to quit. (See DeVito E E and S. Krishnan-Sarin, 2018; Anderson S J, 2011).

The recent increased prevalence in nicotine use due to the introduction of various new e-cigarette products on the market have resulted in a significant increase in attempts at quitting tobacco or nicotine-containing products from 52.8% in 2009 to 55.1% in 2018 ($p<0.001$) and an increase in successful smoking cessation from 6.3% in 2009 to 7.5% in 2018 ($p<0.001$). (Wang et al., 2017). However, despite the increased attempts at quitting smoking, the rate of successful smoking cessation remains dismal. Traditional smoking cessation products and programs include nicotine replacement products and prescription medications. Nicotine replacement products include patches, gum, lozenges, sprays and inhalers, each of which contain and provide to the user various amounts of nicotine. However, each of the available nicotine replacement products have potential side effects, including continued nicotine delivery to a subject. Prescription medications, such as bupropion and varenicline, do not contain nicotine, but they are available only by prescription and also have side effects, some of which are potentially serious.

In view of the above, many smokers recognize the importance of quitting smoking or use of nicotine-containing products and attempt to quit. However, there are often psychological factors at play in why an individual smokes or uses nicotine-containing products which inform whether it is the oral habit or an addiction to nicotine which are not addressed by current smoking cessation products. (DeVito E E and S. Krishnan-Sarin, 2018; Anderson S J, 2011). The psychology of smoking and the smoker is based on the complex interplay of nicotine, genetic, learning, sensory, emotional, reward and punishment sensitivity, and environmental factors that characterize the individual smoker or nicotine user. (Audrain-McGovern J et al. Nat. Cancer Institute, 2009). Substantial evidence indicates that there are many differences between smokers or nicotine users and the factors that drive their smoking and influence their ability to quit smoking or use of nicotine-containing products. (Pergadia M L et al. JAMA Psychiatry, 2014).

Whether smoking is habitual and largely attributed to psychological factors or largely attributed to nicotine dependence can be determined by Fagerstrom Tolerance Questionnaire ("FTQ"; Table 1) and Fagerstrom Test for Nicotine Dependence ("FTND"; Table 2). The Fagerstrom Test for Nicotine Dependence was designed to provide an ordinal measure of nicotine dependence related to cigarette smoking.

TABLE 1

| Fagerstrom Tolerance Questionnaire ("FTQ") | |
|---|---|
| Questions | Answers (Score) |
| How soon after you wake up do you smoke your first cigarette? | Within 30 minutes (1), After 30 minutes (0) |
| Do you find it difficult to refrain from smoking in places where it is forbidden (e.g., in churches, libraries and movies)? | Yes (1), No (0) |
| What cigarette would you most hate to give up? | The first one in the morning (1), Any other (0) |
| How many cigarettes per day do you smoke? | 26 or more (2), 16 to 25 (1), 15 or less (0) |
| Do you smoke more frequently during the first hours after waking than during the rest of the day? | Yes (1), No (0) |
| Do you smoke when you are so ill that you are in bed most of the day? | Yes (1), No (0) |
| What is the nicotine content of the cigarette brand you usually smoke? | 1.3 mg or more (2), 1.0 to 1.2 mg (1), 0.9 mg or less (0) |
| How often do you inhale the smoke from your cigarette? | Always (2), Sometimes (1) |

(Fagerstrom, 1978).

TABLE 2

| Fagerstrom Test for Nicotine-Dependence ("FTND") | |
|---|---|
| Questions | Answers (Score) |
| How soon after you wake up do you smoke your first cigarette? | Within 5 minutes (3), 6-30 minutes (2), 31-60 minutes (1), After 61 minutes (0) |
| Do you find it difficult to refrain from smoking in places where it is forbidden (e.g., in churches, libraries, and movies)? | Yes (1), No (0) |
| What cigarette would you most hate to give up? | The first one in the morning (1), Any other (0) |
| How many cigarettes a day do you usually smoke? | 31 or more (3), 21-30 (2), 11 to 20 (1), 10 or less (0) |
| Do you smoke more frequently during the first hours after waking than during the rest of the day? | Yes (1), No (0) |
| Do you smoke when you are so ill that you are in bed most of the day? | Yes (1), No (0) |

(Heatherton, 1991).

A score of at least 6 points on either of these tests indicates that the person's smoking is largely attributable to nicotine dependence. Conversely, for a person with a score lower than 6, that person's smoking is largely attributable to psychological factors. A survey of company workers and city employees conducted by a public health center showed that nicotine-dependent smoking with a score of at least 6 points is relatively uncommon, indicating that the habitual factor had to do more with the act of smoking in most cases (action of hand to mouth etc.). This suggests the importance of examining and treating smoking from a psychological perspective and tailoring treatment to each individual by addressing the psychological component behind smoking and provide the individual smoker with support and guidance to succeed in stopping smoking.

Thus, there remains a need for more effective smoking cessation methods using products that are nicotine-free and do not contain prescription medications. In addition, there remains a need for smoking cessation methods that address the psychological aspects associated with smoking or use of other nicotine-containing products on an individual basis.

SUMMARY OF THE INVENTION

The inventors have identified that the invention disclosed herein provides compositions and devices for smoking cessation, as well as methods of use of the same smoking cessation product that bypass the above-identified issues by providing satisfying and effective compositions, products and methods of use thereof that do not contain nicotine or prescription pharmaceuticals and associated side effects, according to the disclosure. Although this invention as disclosed herein is not limited to specific advantages or functionality, in one aspect the present disclosure provides a composition comprising a nicotine-free liquid comprising a carrier and menthol, wherein the composition is capable of being volatilized. In some embodiments, the composition further comprises ethyl alcohol.

In a second aspect, the present disclosure provides a method of preparing a nicotine-free composition capable of being inhaled, the method comprising aerosolizing a liquid comprising a carrier and menthol by heating the liquid to a temperature of about 75° C. to about 300° C. using an atomizer, thereby providing an inhalable vapor containing the menthol. In some embodiments, the atomizer further comprises a battery, wherein the power generated by the battery connected to the heating element is about 0.2 to about 200 Joules/second, and wherein the liquid is heated for 1 to 10 seconds.

In a third aspect, the present disclosure provides a method of preparing an inhalable nicotine-free composition comprising aerosolizing a liquid comprising a carrier and menthol using a mesh assembly comprising mesh in the center of the assembly, a piezo actuator surrounding the mesh, and an electrical element, applying an electric charge to the mesh assembly thereby vibrating the mesh and aerosolizing the liquid composition for inhalation. In some embodiments, high frequency sonic waves vibrate the mesh. In some embodiments, the vibrating mesh further comprises a piezoelectric element.

In a fourth aspect, the present disclosure provides a smoking cessation device comprising a composition capable of being volatilized comprising a nicotine-free liquid comprising a carrier and menthol, and a device capable of volatilizing said composition.

In a fifth aspect, the present disclosure provides a method of use of a smoking cessation device by a subject in need thereof, the method comprising: a. inserting the appropriate end of the smoking cessation device into the subject's mouth, the device comprising an inhalable composition comprising a carrier and menthol, b. inhaling for 1-5 seconds, and c. repeating as needed to provide the subject a therapeutically effective amount of the inhalable composition.

In a sixth aspect, the present disclosure provides a kit for treating a subject with a nicotine-free composition for cessation of smoking comprising: a. a therapeutically effective amount of an inhalable vapor comprising menthol; b. an apparatus for administering said composition; and c. instructions for use.

In a seventh aspect, the present disclosure provides a system capable of tracking, monitoring and assisting in progress regarding nicotine cravings and associated smoking cessation by a subject. In some embodiments, the system is through an application available for smart devices and/or networked microprocessors.

These and other features and advantages of the present invention will be more fully understood from the following detailed description taken together with the accompanying claims. It is noted that the scope of the claims is defined by the recitations therein and not by the specific discussion of features and advantages set forth in the present description.

BRIEF DESCRIPTION OF THE DRAWINGS

The accompanying drawings are included to provide a further understanding of the methods and compositions of the disclosure, and are incorporated in and constitute a part of this specification. The drawings illustrate one or more embodiment(s) of the disclosure, and together with the description serve to explain the principles and operation of the disclosure.

DETAILED DESCRIPTION OF THE INVENTION

Figure 1:
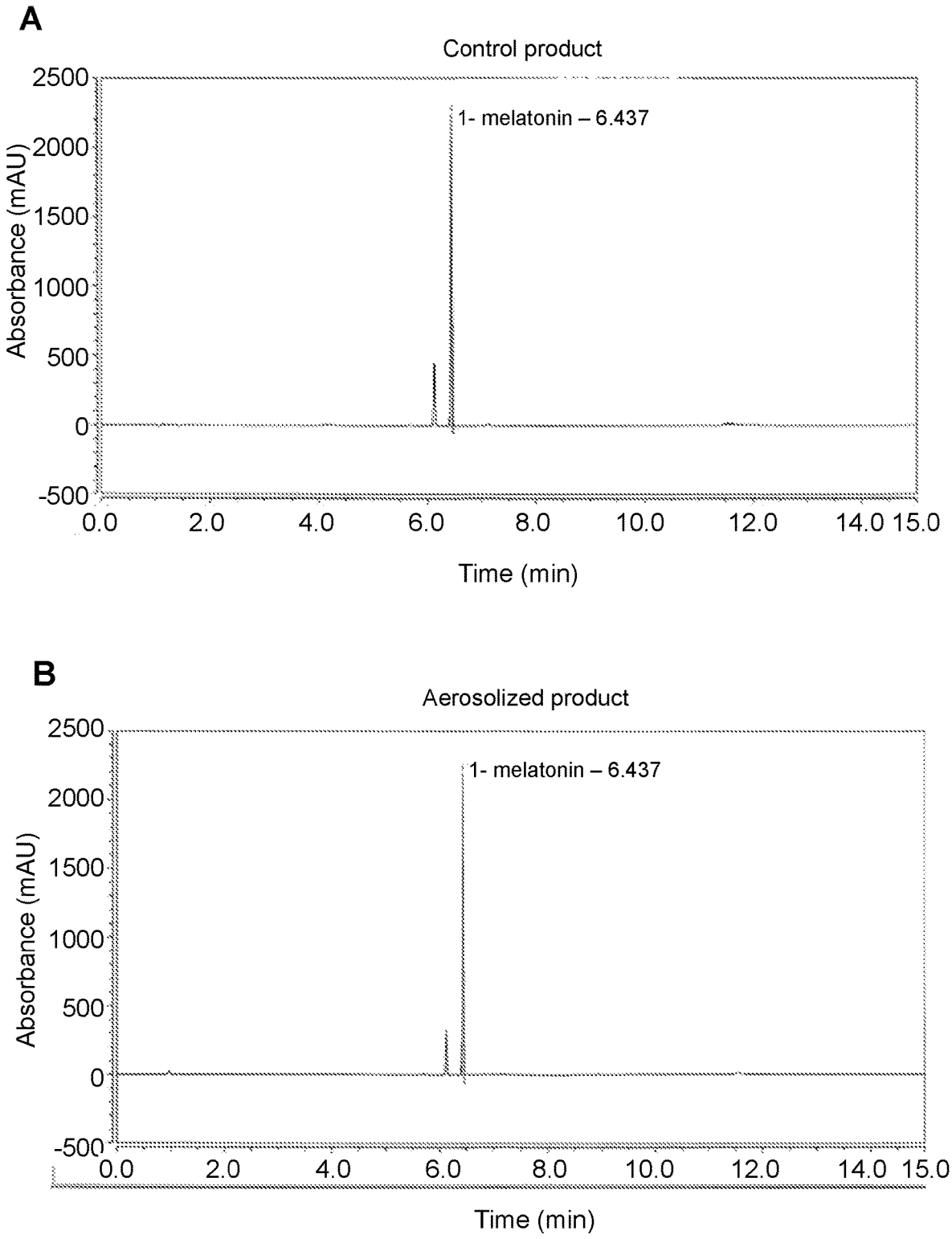
FIG. 1 illustrates that melatonin is present in the aerosolized state. (A) Chromatogram of sample of product containing melatonin prior to vaporization, tested by HPLC. (B) Chromatogram of same sample after vaporization into water reservoir present in the impinger, tested by HPLC. (HPLC Instrument method: C18 pH6 full gradient; Run Time: 15 min; Injection volume: 5 μl; Wavelength: 210.0 nm; Bandwidth: 10; Dilution Factor: 1.0000; Sample weight: 1.0000).

Before the disclosed processes and materials are described, it is to be understood that the aspects described herein are not limited to specific embodiments or configurations, and as such can, of course, vary. It is also to be understood that the terminology used herein is for the purpose of describing particular aspects only and, unless specifically defined herein, is not intended to be limiting.

It is also to be understood that unless clearly indicated otherwise by the context, embodiments disclosed for one aspect or embodiment of the invention can be used in other aspects or embodiments of the invention as well, and/or in combination with embodiments disclosed in the same or other aspects of the invention. Thus, the disclosure is intended to include, and the invention includes, such combinations, even where such combinations have not been explicitly delineated.

Definitions

Throughout this specification, unless the context requires otherwise, the word "comprise" and "include" and variations (e.g., "comprises," "comprising," "includes," "including") will be understood to imply the inclusion of a stated component, feature, element, or step or group of components, features, elements or steps but not the exclusion of any other integer or step or group of integers or steps.

As used in the specification and the appended claims, the singular forms "a," "an" and "the" include plural referents unless the context clearly dictates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the term "contacting" includes the physical contact of at least one substance to another substance.

As used herein, the terms "vaporize" or "vaporized" and "aerosolize" or "aerosolized" are used interchangeably herein and refer to diffusing or suspending a composition in the air, such that it is suitable for inhalation into a subject's lungs. As disclosed herein, examples of vaporization or aerosolization include: heating a liquid composition with or without an atomizer, use of vibrating mesh with a piezo actuator and/or ultrasonic frequencies, and applying ultrasonic waves directly into the liquid composition, to diffuse or suspend the composition in the air, such that it is suitable for inhalation into a subject's lungs.

As used herein, "treatment," "therapy" and/or "therapy regimen" refer to treatment or intervention made in response to a disease, disorder or condition manifested by a patient or to which a patient may be susceptible. The aim of treatment includes the alleviation or prevention of symptoms, slowing or stopping the progression or worsening of a disease, disorder, or condition and/or the remission of the disease, disorder or condition.

The term "effective amount" or "therapeutically effective amount" refers to an amount sufficient to effect beneficial or desirable biological and/or clinical results.

As used herein, the term "subject" and "patient" are used interchangeably herein and refer to humans.

As used herein, the term "disease" refers to any condition that is abnormal, such as a disorder or a structure or function that affects part or all of a subject.

As used herein, the term "electronic inhaler" or "e-inhaler" are used interchangeably herein and refer to a device capable of vaporizing or aerosolizing a liquid composition for inhalation. By way of non-limiting example, an electronic inhaler can include e-cigarette-type devices that have an atomizer and a battery, or a vibrating mesh with a piezo actuator.

As used herein, references to "one embodiment", "an embodiment", or "in embodiments" mean that the feature being referred to is included in at least one embodiment of the disclosure. Furthermore, separate references to "one embodiment", "an embodiment", or "in embodiments" do not necessarily refer to the same embodiment, but also are not necessarily mutually exclusive unless explicitly stated herein, or as otherwise will be readily apparent to one of skill in the art. Accordingly, the disclosure can include any variety of combinations and/or integrations of the embodiments described herein.

The Psychology Behind Smoking and Nicotine Habits or Addiction

To understand habits and the psychological perspective behind smoking, researchers have looked to "reward learning," which is a process by which organisms acquire information about stimuli, actions, and contexts, including sensory contexts, that predict positive out-comes. A frequent outcome in this process serves as a catalyst to habit formation—sequential, repetitive, motor or cognitive behaviors elicited by external or internal triggers that can go to completion without conscious oversight. Nicotine enhances dopamine release in reinforcement/reward circuits in the brain and thereby may be associated with increased attention to and effort for reward related stimuli. Smokers who recognize the psychological motivation behind their dependence can find opportunities to substitute reward expectations from nicotine with alternative therapies, ideally leading to a modification of pre-existing habits.

Sleep disturbance is commonly reported as a prominent subjective symptom by smokers trying to quit. In addition, after overnight abstinence (while sleeping), a majority of smokers find the first cigarette of the day to be particularly satisfying, promoting a sustained cycle of cigarette use. (Lessov-Schlagger C N et al. Biochem Pharmacol, 2008). The inventors have discovered a non-nicotine formulation that will provide a satisfying sensation similar to that of traditional cigarettes or e-cigarettes, but without use of nicotine. Use of the invention disclosed herein on a regular basis by a subject with a smoking habit or nicotine addiction will reduce cravings and create new, more positive habits and behavior, allowing the subject to stop using products which contain nicotine.

The present disclosure provides improved formulations, products and methods for smoking cessation that do not contain any nicotine or tobacco. Additionally, the present disclosure provides systems that address the psychological factors behind smoking to provide a more effective smoking cessation system tailored to each individual based on targeted approaches designed to address and overcome the psychological issues affecting that individual.

The Clearance Mechanisms of the Lung

The lung engages mechanisms, including airway geometry, humidity and clearance mechanisms, to filter unwanted airborne particles and prevent them from entering the body (Labiris, N R & Dolovich, M B. *J Clin Pharmacol,* 2003, 56:588-599). Progressive branching and narrowing of the airways promote impaction of particles. In addition, the lung has a relative humidity of approximately 99.5% (Labiris & Dolovich, 2003).

Particle size is an important variable to determine the dose deposited and the distribution of aerosolized compositions in the lung. (Labiris & Dolovich, 2003). Most therapeutic aerosols are heterodisperse, consisting of a wide range of particle sizes and described by the log-normal distribution, with the log of the particle diameters plotted against particle number, surface area or volume (mass) on a linear or probability scale and expressed as absolute values or cumulative percentage. (Labiris & Dolovich, 2003).

Depending on their size, particles can be deposited by inertial impaction, gravitational sedimentation or diffusion (Brownian motion). Particles not deposited during inhalation are exhaled. Particles smaller than 0.5 mm are mainly deposited by diffusion. Drug particles are known to be hygroscopic and grow or shrink in size in high humidity, such as in the lung. A hygroscopic aerosol that is delivered at relatively low temperature and humidity into one of high humidity and temperature would be expected to increase in size when inhaled into the lung. The rate of growth is a function of the initial diameter of the particle, with the potential for the diameter of fine particles<1 mm to increase five-fold compared with two-to-three-fold for particles>2 mm. (Labiris & Dolovich, 2003).

To take advantage of this direct delivery mechanism to the lungs, aerosolized droplets smaller than 500 nanometers in diameter avoid sedimentation in airways leading to deposition by diffusion in the alveoli. (Grana, R, et al. *Circulation,* 2014, 129 (19):1972-1986). As the major component of the aerosol, the kinetic and thermodynamic behavior of vegetable glycerin dictates the behavior of the mixture. Initial size of vegetable glycerin aerosols have a peak diameter of 120-180 nanometers. (Grana, R, et al., 2014; Zhang, Y, et al. *Nicotine & Tobacco Research,* 2012, 15 (2):501-508). The distribution of particle diameters for aerosols are comparable with that of cigarette smoke, which falls within the parameters for deposition by diffusion, providing optimal alveolar deposition. (Zhang, Y, et al, 2012).

After deposition in the alveoli, absorption by diffusion into the bloodstream is the major method of clearance from the lungs. (Labiris & Dolovich, 2003). Molecules<6 nm rapidly diffuse into the bloodstream following inhalation. (Labiris & Dolovich, 2003). Up to 18% of the aerosol volume is deposited in the alveoli and up to 27% of the total aerosol volume is delivered for systemic circulation (Grana, R, et al., 2014). This is in line with the 25% to 35% total absorption rate of cigarette smoke, a proven delivery mechanism (Grana, R, et al., 2014).

In view of the present disclosure, the methods and compositions described herein can be configured by the person of ordinary skill in the art to meet the desired need. In general, the disclosed materials provide formulations of inhalable compositions, methods of preparing the same and methods of use as a smoking cessation product or device.

This disclosure provides one method of preparing the composition comprising aerosolizing a liquid comprising a carrier and menthol by heating the liquid using an atomizer, thereby providing an inhalable vapor containing the inhalable supplement. Alternatively, a second method of preparing the composition comprises aerosolizing a liquid comprising a carrier and menthol using a vibrating mesh The disclosed compositions, devices and methods advantageously aerosolize the inhalable composition so as to provide a similar mouth feel and "throat hit" as that of nicotine, but without the numerous side effect that cone with use of nicotine. This provides a satisfying alternative to nicotine-based products and enables a person with a nicotine addiction or smoking habit to overcome cravings and the addiction or habit without further use of nicotine-containing products.

In another aspect, the present disclosure provides for methods of treating a subject with a supplement comprising administering to the subject a therapeutically effective amount of an inhalable vapor containing a supplement. In some embodiments, the inhalable vapor comprises a liquid comprising a carrier and a supplement, and wherein the liquid is aerosolized by heating the liquid to a temperature of about 25° C. to about 300° C. using an atomizer. In some embodiments, the inhalable vapor is administered in a single dose or in multiple doses.

In another aspect, the present disclosure provides for kits for treating a subject with an inhalable supplement.

In some embodiments, the liquid comprising the carrier and the inhalable supplement is present as a mixture, for example, a homogeneous mixture or a heterogeneous mixture. In some embodiments, the liquid comprising the carrier and the inhalable supplement is present as a suspension. In some embodiments, the liquid comprising the carrier and the inhalable supplement is present as a solution. In some embodiments, the liquid is free of nicotine. In some embodiments, the liquid comprises nicotine.

In another aspect, the liquid comprises about 51% (w/w) to about 99.99999% (w/w) carrier. In some embodiments, the liquid comprises about 0.00001% (w/w) to about 49% (w/w) inhalable supplement.

There are health concerns of toxic carbonyl exposure when heat is used to aerosolize suspensions of propylene glycol and vegetable glycerin [1]. When excess heat is applied to these solvents, volatile carbonyl degradation products are known to form at increasing rates (e.g. formaldehyde, acetaldehyde and acrolein) (Grana, R, et al., 2014). Propylene glycol has been excluded from all products as it is known to oxidize and degrade at low temperatures. Products instead utilize carriers comprising, for example, organic vegetable glycerin suspensions to aerosolize our inhalable nutrients. Five-watt heating coils have similar technical specifications and can serve as an effective model for our products. During intermittent use of a 5 W coil, temperatures remain well below 200° C., which has been shown to avoid substantial increase in carbonyl production (Wang, P, et al. *PLoS ONE,* 2017, 12 (1): e0169811).

Suitable carriers include, but are not limited to glycerin, such as vegetable glycerin, 1,3-propanediol, and combinations thereof. In some embodiments, the carrier comprises a mixture of glycerin and 1,3-propanediol. In some embodiments, the carrier comprises glycerin and 1,3-propanediol present in a weight ratio of 1:1000 to 1000:1.

Suitable compositions include, but are not limited to, menthol. In some embodiments, the composition can further comprise one or more supplements. Such supplements include, but are not limited to vitamin B1, vitamin B2, vitamin B6, vitamin B12, ascorbic acid, biotin, melatonin, L-theanine, caffeine, and combinations thereof. In some embodiments, the inhalable composition comprises a carrier and menthol. In some embodiments, the composition comprises a carrier, menthol and one or more supplements selected from: vitamin B1, vitamin B2, vitamin B6, vitamin B12, ascorbic acid, biotin, or combinations thereof. In some embodiments, the inhalable composition comprises a carrier, menthol and the supplement melatonin. In some embodiments, the inhalable composition comprises a carrier, menthol and the supplement L-theanine. In some embodiments, the inhalable composition comprises a carrier, menthol and the supplement caffeine. In some embodiments, the inhalable composition comprises a carrier, menthol and a supplement comprising a mixture of L-theanine and caffeine.

In another aspect, the inhalable composition has a boiling point greater than the temperature to which the liquid is heated.

In another aspect, the atomizer comprises a heating element to vaporize the liquid. In some embodiments, the atomizer further comprises a delivery mechanism that actively or passively transports the liquid to the heating element. In some embodiments, the atomizer further comprises a wicking material as a delivery mechanism to draw the liquid to the heating element. In some embodiments, the atomizer does not contain a wicking material. In some embodiments, the liquid is dripped directly onto the heating element. In some embodiments, the atomizer is a ceramic atomizer. In some embodiments, the heating element has a resistance of about 0.4 ohms to about 6 ohms. In some embodiments, the heating element is connected to a 1- to 9.1-volt battery. In some embodiments, the liquid is heated for about 1 to about 10 seconds.

In another aspect, the vapor produced by the methods described herein contains particles having a mass mean aerodynamic diameter of less than about 50 microns.

In embodiments in which the composition includes one or more supplements, inhalation of the vapor by a subject increases plasma levels of the one or more supplements in the subject. In some embodiments, plasma levels of the one or more supplements are detectably increased compared to plasma levels before inhalation of the vapor within about 1 to 120 minutes, for example, about 30 to about 120 minutes or about 30 to about 90 minutes, or about 30 to about 60 minutes, or about 30 to about 45 minutes, or about 60 to about 120 minutes, or about 60 to about 90 minutes, or about 60 to about 75 minutes after inhalation of the vapor. In some embodiments, blood plasma levels of the one or more supplements in the subject are increased compared to plasma levels before inhalation of the vapor by, for example, at least 3%.

Formulations

The liquid preparations disclosed herein include a carrier component and a crystalline menthol component. To enable the crystalline menthol to go into solution, in some embodiments, the liquid preparation can also include trace amounts of ethyl alcohol. The liquid preparations are present in a device that is suitable to aerosolize the liquid, thereby providing an inhalable vapor containing the supplement.

Typically, about 0.1 to about 100 ml of liquid is present in the device, for example, about 0.1 to about 10 ml, about 0.5 to about 2 ml, about 1 to 1.5 ml, and/or about 1 to about 1.2 ml. In some cases, about 0.1 mg to about 100 g of liquid is present in the device, for example, about 500 mg to about 1.5 g, about 200 mg to about 1.2 g, about 0.1 mg to about 15 mg, about 0.2 mg to about 10 mg, about 0.5 mg to about 5 mg, about 0.5 mg to about 3 mg, about 1 mg to about 2 mg, about 1.1 mg to about 1.7 mg, and/or about 1.3 mg to about 1.5 mg of liquid. The liquid comprising the carrier and the inhalable supplement can be present as a mixture, for example, a homogeneous mixture or a heterogeneous mixture, a solution, or a suspension.

In some embodiments, the carrier component includes any carrier suitable for aerosolizing the inhalable supplement at relatively low temperatures, such as at a temperature below the boiling point of the inhalable supplement. Without wishing to be bound by theory, it is believed that aerosolizing the inhalable supplement at a temperature below its boiling point reduces degradation of the inhalable supplement, thereby facilitating delivery of the inhalable composition to a subject in an amount sufficient to achieve a desired effect in the subject. The liquid preparations contain an amount of carrier suitable to allow a desired amount of inhalable menthol to be aerosolized under conditions that allow the menthol to be delivered to a subject. In some embodiments, the liquid contains the carrier component and the menthol component in a weight ratio of about 1:1 to about 1000:1, about 2:1 to about 1000:1, about 5:1 to about 1000:1, about 10:1 to about 1000:1, about 5:1 to about 10:1, about 7:1 to about 10:1, and/or about 1:1 to about 1:1000. Suitable carriers include, but are not limited to glycerin, such as vegetable glycerin, 1,3-propanediol, and combinations thereof. In some embodiments, the carrier is a vegetable glycerin derived from palm oil, soybean oil or coconut oil. In some embodiments, the carrier is a vegetable glycerin derived from organic palm oil. In some embodiments, the carrier comprises glycerin and 1,3-propanediol in a weight ratio of 1:1000 to 1000:1, for example, 1:10 to 10:1, 1:7.5 to 7.5:1, 1:5 to 5:1, 1:4 to 4:1, 1:3 to 3:1, 1:2 to 2:1, 1:1.5 to 1.5:1, and/or 1:1.

Propylene glycol (1,2-propanediol) is a carrier widely used in conventional e-cigarettes that contain nicotine because it has good properties as a solvent and provides a sensation known as "throat hit" which mimics that achieved from traditional cigarettes. However, propylene glycol is a known irritant to the eyes and skin, causing contact dermatitis, and may lead to increased inflammation in the lungs when inhaled. For these reasons, among others, propylene glycol is not considered to be a suitable carrier pursuant to this disclosure.

The carrier component often comprises more than half of the total weight of the liquid. In some cases, for example, the liquid comprises about 51% (w/w) to about 99.99999% (w/w), about 60% (w/w) to about 99.9999%, about 60% (w/w) to about 99.999%, about 60% (w/w) to about 99.99%, about 60% (w/w) to about 99.9%, about 60% (w/w) to about 95% (w/w), about 70% (w/w) to about 95% (w/w), about 80% (w/w) to about 99.9% (w/w), about 80% (w/w) to about 95% (w/w), about 80% (w/w) to about 90% (w/w), and/or about 85% (w/w) to about 90% (w/w) carrier based on the total weight of the liquid. In such embodiments, the menthol comprises less than half of the total weight of the liquid. In some embodiments, for example, the menthol comprises about 0.00001% (w/w) to about 49% (w/w), about 0.0001% (w/w) to about 40% (w/w), about 0.001% (w/w) to about 40% (w/w), about 0.01% (w/w) to about 40% (w/w), about 0.1% (w/w) to about 40% (w/w), about 5% (w/w) to about 40% (w/w), about 5% (w/w) to about 30% (w/w), about 0.01% (w/w) to about 20% (w/w), about 5% (w/w) to about 20% (w/w), about 10% (w/w) to about 20% (w/w), and/or about 10% (w/w) to about 15% (w/w) menthol based on the total weight of the liquid.

In some embodiments, about 0.1 to about 100 ml of carrier is present in the device, for example, about 0.1 to about 10 ml, about 0.5 to about 2 ml, about 1 to 1.5 ml, and/or about 1 to about 1.2 ml of carrier. In some embodiments, about 0.1 mg to about 100 g of carrier is present in the device, for example, about 500 mg to about 1.5 g, about 200 mg to about 1.2 g, about 0.1 mg to about 15 mg, about 0.2 mg to about 10 mg, about 0.5 mg to about 5 mg, about 0.5 mg to about 3 mg, about 1 mg to about 2 mg, about 1.1 mg to about 1.7 mg, and/or about 1.3 mg to about 1.5 mg of carrier.

In some embodiments, about 0.01 mg to about 100 mg of menthol is present in the device, for example, about 0.03 mg to about 1.5 mg, about 0.05 mg to about 1 mg, about 0.1 mg to about 0.5 mg, about 0.15 mg to about 0.2 mg, about 11 mg to about 50 mg, about 43 mg to about 90 mg, about 37 mg to about 100 mg, and/or about 1 mg to about 17 mg of menthol.

Inhalable compositions for use in the formulations and methods disclosed herein include ingredients intended to provide a satisfying, pleasurable and soothing effect that is nicotine-free, but which mimics, in part, the sensation provided by traditional cigarettes or e-cigarettes. In some aspects, the inhalable compositions provide a benefit to the health of the subject to which the inhalable composition is administered as a smoking cessation device or product.

In some embodiments, the inhalable compositions further include one or more of dietary supplements, stimulants, relaxants, minerals, vitamins, hormones, and other compounds with biological functionality or a biological response within in the subject. Inhalable supplements include, but are not limited to, nutrients, such as vitamins, minerals, amino acids and proteins, fiber, and fatty acids, and biologically active compounds. Such supplements include, but are not limited to vitamin B1, vitamin B2, vitamin B6, vitamin B12, ascorbic acid, biotin, melatonin, L-theanine, caffeine, and combinations thereof. In some embodiments, the inhalable composition comprises a carrier and menthol. In some embodiments, the composition comprises a carrier, menthol and one or more supplements selected from: vitamin B1, vitamin B2, vitamin B6, vitamin B12, ascorbic acid, biotin, or combinations thereof. In some embodiments, the inhalable composition comprises a carrier, menthol and the supplement melatonin. In some embodiments, the inhalable composition comprises a carrier, menthol and the supplement L-theanine. In some embodiments, the inhalable composition comprises a carrier, menthol and the supplement caffeine. In some embodiments, the inhalable composition comprises a carrier, menthol and a supplement comprising a mixture of L-theanine and caffeine. In some embodiments, the supplement has a boiling point greater than the temperature to which the liquid is heated. For example, the difference between the temperature to which the liquid is heated and the boiling point of the supplement typically is at least 10° C., for example, at least 20° C., at least 30° C., at least 50° C., at least 75° C., at least 100° C., at least 150° C., and/or at least 200° C.

The liquid formulations may include additional components such as flavorings, crowding reagents, and/or a compound that alters the solubility of the inhalable supplement. Suitable flavorings include, but are not limited to French vanilla flavor, cream flavor, regular vanilla flavor, honey, raspberry, strawberry, watermelon, blueberry, peach, cherry, chocolate, dark chocolate, milk chocolate, passion fruit, pomegranate, loganberry, banana, cinnamon, licorice, lychee, dragon fruit, tangerine, banana, tea, milk, lavender, orange, coffee, chamomile, mint, peppermint, spearmint, cereal, and mixtures thereof. Suitable compounds that alter the solubility of one or more components of the inhalable composition includes but are not limited to alcohols, ethers and essential oils. In certain embodiments, the crystalline menthol is solubilized with ethyl alcohol. In some embodiments, ethyl alcohol is added to aid in solubilizing crystalline menthol in a concentration of between 0.01% and 0.15% by volume. In certain embodiments, the concentration of ethyl alcohol added is 0.05% by volume.

Methods for Vapor Preparation

The disclosure provides methods for preparing an inhalable vapor containing a carrier and solubilized menthol. The inhalable vapor is prepared by aerosolizing a liquid preparation containing menthol as described herein. The liquid preparations are present in a device that is suitable to aerosolize the liquid, thereby providing an inhalable vapor containing menthol.

In one aspect, the liquid is aerosolized by heating the liquid to a relatively low temperature, such as a temperature below the boiling point of the inhalable composition. As discussed above, aerosolizing the supplement at a relatively low temperature (i.e., a temperature below the supplement's boiling point) is reduces degradation of the supplement, thereby facilitating delivery of bioactive supplement to a subject. Typically, the liquid is heated to a temperature of about 75° C. to about 300° C., for example, about 75° C. to about 105° C., about 100° C. to about 200° C., about 110° C. to about 260° C., and/or about 80° C. to about 300° C.

The liquid is heated for a relatively short period of time (e.g., less than 10 seconds) to avoid overheating of the liquid and to rapidly aerosolize the supplement for delivery to the subject. In some embodiments, the liquid is heated for about 1 to about 10 seconds, for example, about 1 to about 8 seconds, about 1 to about 6 seconds, about 1 to about 5 seconds, about 1 to about 4 seconds, about 1 to about 3 seconds, about 1 to about 2 seconds, about 2 to about 10 seconds, about 2 to about 8 seconds, about 2 to about 6 seconds, about 2 to about 5 seconds, about 2 to about 4 seconds, about 3 to about 10 seconds, about 3 to about 8 seconds, about 3 to about 6 seconds, about 3 to about 5 seconds, about 3 to about 4 seconds, about 1 second, about 2 seconds, and/or about 3 seconds.

Various devices can be used to heat the liquid and aerosolize the supplement. In particular, devices containing an atomizer are used and the atomizer is used to heat the liquid. Exemplary devices contain an atomizer and a power source, such as a battery, connected to the atomizer. In some cases, the atomizer comprises a heating element to vaporize the liquid. In some cases, the atomizer further comprises a delivery mechanism that actively or passively transports the liquid to the heating element. In some cases, the atomizer further comprises a wicking material as a delivery mechanism to draw the liquid to the heating element. In some embodiments, the atomizer does not contain a wicking material. In some embodiments, the liquid is dripped directly onto the heating element. In some embodiments, the atomizer is a ceramic atomizer. In some embodiments, the heating element has a resistance of about 0.4 ohms to about 6 ohms, for example, about 0.8 ohms to about 5 ohms, about 1 ohm to about 4 ohms, about 1 ohm to about 2 ohms, and/or about 2 ohms to about 3 ohms. Suitable voltages for the battery that is connected to the heating element include, but are not limited to, 1 to 9.1 volts, 3 to 6 volts, 4 to 5 volts, 4 to 4.5 volts, and/or 4.15 volts. In some cases, the power generated by the battery that is connected to the heating element is about 0.2 to about 200 Joules/second, for example, about 0.3 to about 100 Joules/second, about 0.4 to about 75 Joules/second, about 0.5 to about 50 Joules/second, about 1 to about 40 Joules/second, about 2 to about 20 Joules/second, and/or about 3 to about 10 Joules/second. Suitable materials from which the wicking material is comprised include, but are not limited to, cotton, silica, polyester, ceramic, fiberglass, and stainless steel.

In another aspect, the liquid composition is aerosolized using a vibrating mesh membrane. More specifically, the liquid composition is located on the top surface of a mesh membrane perforated with tapered micro-sized holes. The device also includes a piezoelectric actuator ring which radially surrounds the mesh membrane. The piezoelectric actuator is excited at ultrasonic frequencies which induce vibration of the mesh membrane. The liquid composition is then drawn through the micro-sized holes in the mesh membrane, creating a homogenous droplet distribution of the liquid composition as an inhalable aerosol, with a droplet size range of about 1 μl to about 10 μl. The mesh membrane can be made of any composition appropriate for vibration and drawing the liquid through, including but not limited to metal, metal alloys or silicone of an appropriate thickness. The mesh membrane can also be coated with a corrosion resistant coating, such as but not limited to palladium, gold, or another corrosion resistant metal. In addition, or in the alternative, the mesh membrane can also be coated with a substance that inhibits or prevents bacterial growth, including but not limited to silver. The piezoelectric actuator ring can be made of any appropriate material, such as but not limited to ceramic. Use of vibrating mesh prevents overheating of the liquid composition, preventing degradation, as disclosed above. In some embodiments, the mesh membrane contains between 50 and 100 tapered micro-sized holes per $mm^2$. In some embodiments, the mesh membrane is domed to allow for sufficient dispersion of the aerosolized composition.

The vapor produced by the methods described herein contains particles having a particle size suitable for inhalation and absorption in the lungs of a subject. In some cases, the vapor contains particles having a mass mean aerodynamic diameter of less than about 50 microns for example, about 0.1 micron to about 15 microns, about 1 nm to about 500 nm, about 10 nm to about 250 nm, and/or about 100 nm to about 200 nm.

Logging or Transmission of Data Regarding Use of Nicotine-Free Smoking Cessation Device Via Smart Device As disclosed herein, a smart device (e.g., smartphone, tablet, personal digital assistant, or a wearable digital device such as a wrist or arm device) having wireless access to the Internet is provided with a software application ("App"). Within the App, the subject initially provides information regarding his or her history of smoking and/or nicotine use (e.g., types of tobacco or nicotine-containing products used, frequency and duration of use of each, etc.), self-assessment of associated psychological factors (e.g., reasons for smoking, stress levels, timing and intensity of cravings, typical symptoms of cravings, sensory or oral fixation, etc.), goals and self-imposed timelines for progress, for example. The subject may modify or update any of this initial information at any time within the App. As disclosed herein, the subject using the nicotine-free smoking cessation or nicotine replacement device can access the App to perform any number of tasks, including but not limited to, report or log use of the device, report or log cravings, report or log symptoms associated with a craving, report, log or monitor progress related to established goals related to smoking cessation or nicotine replacement by the subject. In response to a task performed by the subject, the App provides, lists, suggests or identifies one or more courses of action for the subject to select undertaking to, for example, overcome a craving or to otherwise assist the subject in progressing towards an established goal related to smoking cessation or nicotine replacement. In some embodiments, such a course of action for the subject to select can include, but is not limited to, using the nicotine-free smoking cessation or nicotine replacement device, meditating for a specified period of time, a distraction for a specified period of time, chatting in real-time with a help line representative, chatting with other subjects via a group chat or support group. In some embodiments, the App can provide, list, suggest or identify different courses of action based on patterns of the subject's behavior identified by the App based on aggregate data. For example, in such embodiments, where a subject logs a craving at a specific time or range of time each day, the App can identify this pattern of behavior based on aggregate data. In response, the App can provide, list, suggest or identify one or more courses of action based on the identified pattern of behavior by the subject. In some embodiments, the App can automatically and preemptively provide, list, suggest or identify such one or more courses of action to a subject.

In some embodiments, the disclosure provides that the smart device is in wireless communication with a nicotine-free smoking cessation or nicotine replacement device. In such embodiments, the smart device and nicotine-free smoking cessation or nicotine replacement device can be enabled with Wi-Fi, Bluetooth, RF radio, infrared, or any other wireless technology. In such embodiments, the smart device collects information from the nicotine-free smoking cessation or nicotine replacement device and transmits the results in real-time or near real-time over the internet to a server. Such readings may include, but are not limited to, each instance of use of the device, duration of each use, time of day of each use, or any combination thereof. The data may be encrypted for transmission to the server. In some embodiments, the server is a secure server.

In some embodiments, the smart device can continuously poll the nicotine-free smoking cessation or nicotine replacement device, or can periodically poll said device for information of use at a specific, predetermined time (e.g., hourly, daily, weekly) or whenever internet access is or becomes available. In such embodiments, communication between the smart device and the nicotine-free smoking cessation or nicotine replacement device is automatic and does not require action by the subject. However, the subject can also adjust when the smart device retrieves data from the nicotine-free smoking cessation or nicotine replacement device, or can manually prompt the smart device to retrieve such data.

The data may be displayed on a graphical user interface of the subject's smart device before and/or after the data are transmitted to the server. In specific embodiments, the data may be displayed, for example, in one or more tabs of the App, and/or as a table, pie chart, or graph. In some embodiments of the present disclosure, the transmitted data are transmitted from the secure server to one or more authorized microprocessors or computers located on the network. In specific embodiments, the secure server receives data from a subject's smart device, maintaining or storing each subject's data separately, and aggregating the subject's data. When the server received data or aggregates data for an individual that are above at least one predetermined threshold for the subject, the system disclosed herein may communicate a preemptive message to the subject, such as, e.g., "Are you having a craving?" or "You typically have a craving around 8:00 in the morning, would you like assistance?". Depending on the response by the subject, the system disclosed herein may communicate additional messages and/or provide recommendations for patient action to reduce or eliminate the immediate or future cravings, or provide references to educational materials (e.g., materials accessible via a web link in the message, via a link to a location on the App, or via an email sent to the subject's smart device). The at least one predetermined threshold may be set as a default by the system, and/or may be modified, overridden or set up individually by each subject.

Secure Communication or Chat Modules

In accordance with the systems and methods of the present disclosure, a subject may select or request to chat or otherwise communicate in real-time with a representative via the subject's smart device. Accordingly, in specific embodiments, an App on the subject's smart device and the one or more authorized microprocessors or computers for use by authorized personnel, such as, e.g., an administrator, or a help line representative, etc., may have a secure communication or chat module, which enables or provides for two-way communication or messaging. In specific embodiments, the communications may use a smart device's data plan and communicate through the server (e.g., a secure server) to which the subject's data is transmitted.

As disclosed above, in some embodiments, communications or messages may be sent to the subject by a help line or chat representative, providing assistance to said subject. In specific embodiments, the help line or chat representative may communicate additional messages, provide recommendations for action by the subject to reduce or eliminate the immediate or future cravings, or provide references to educational materials (e.g., materials accessible via a web link in the message, via a link to a location on the App, or via an email sent to the subject's smart device). The subject may respond with comments or questions for the help line or chat representative through a dialogue to provide assistance with reducing or eliminating the immediate craving and for dealing with future cravings.

In some embodiments of the present disclosure, the disclosed system and methods include a support group messaging or chat feature or module for subjects using the nicotine-free smoking cessation device to provide support, encouragement and tips to other subjects for reducing or eliminating the immediate craving or for dealing with future cravings. In specific embodiments, the communications may use a smart device's data plan and communicate through the server (e.g., a secure server) to which the subject's data is transmitted. The support group messaging or chat module may be in addition to or in the alternative to a feature providing live secure communication with a help line or chat representative.

Graphical User Interface ("GUI") of Smart Device

As identified above, a GUI may be installed on the one or more authorized microprocessors or computers located on the network for use by authorized personnel, such as, e.g., an administrator, or a help line representative, etc. In some embodiments, the GUI on an authorized microprocessor or computer allows authorized personnel to chat with or switch between more than one subject, for example, through a menu, tabs, pop-ups, alerts or banners. Said GUI may also allow authorized personnel to switch, reroute or assign a subject to one or more other authorized microprocessors or computers located on the network for use by other available authorized personnel.

The systems and methods of the present disclosure provide that the secure server or one or more authorized microprocessors or computers may aggregate a subject's data transmitted from a nicotine-free smoking cessation or nicotine replacement device for a given time period (e.g., hourly, daily, weekly, etc.). one or more authorized microprocessors or computers and/or secure server may use the aggregated data to identify trends in a subject's habits and use of the nicotine-free smoking cessation or nicotine replacement device over time, including, e.g., frequency of use at certain times of a day or night and changes over time, frequency of use each day and changes over time, or responses to automatic communications or requested communications through chat with authorized personnel and changes over time. Identified trends in a subject's aggregated data regarding use, cravings and/or responses to communications via the App may be displayed on a GUI of the subject's smart device before and/or after the data are transmitted to the server. In specific embodiments, the identified trends based on a subject's aggregated data may be displayed, for example, as a table, pie chart, or graph.

However, in embodiments provided in this disclosure, the App on a subject's smart device allows the subject to view or see only that subject's information, data and communications throughout the App, including, e.g., any menus, tabs, links, alerts or banners.

Thus, in a seventh aspect, the present disclosure provides a system capable of tracking, monitoring and assisting in progress regarding nicotine cravings and associated smoking cessation by a subject. In some embodiments, the system includes an application ("App") available for smart devices. In such embodiments, the App may provide for logging or transmission of data regarding use of the nicotine-free smoking cessation or nicotine replacement device via the App on the subject's smart device. In specific embodiments, the system and App may provide a secure automatic communication or chat feature, and/or a secure real-time communication or chat feature with authorized personnel, to assist with questions or cravings, or to provide information, recommendations or tips to reduce or eliminate the immediate craving or future cravings. In some embodiments, the system includes a graphical user interface ("GUI") through the App available for smart devices.

Disclosed here in a system 100 according to an example embodiment of the present disclosure. The system comprises a nicotine-free smoking cessation or nicotine replacement device for a subject 101. Data from the nicotine-free smoking cessation or nicotine replacement device are transmitted wirelessly to a secure server 102 by way of subject's smart device 103. The subject manually inputs data including history of smoking and/or nicotine use (e.g., types of tobacco or nicotine-containing products used, frequency and duration of use of each, etc.), self-assessment of associated psychological factors (e.g., reasons for smoking, stress levels, timing and intensity of cravings, typical symptoms of cravings, sensory or oral fixation, etc.), goals and self-imposed timelines for progress 110. Such smart device has an App for receiving, transmitting and displaying data and provides a secure messaging or chat module 104 for displaying messages between the subject and authorized personnel in a graphical user interface ("GUI") 105. In addition, the data transmitted to a secure server 102 may be accessed by one or more authorized microprocessors or computers 106 which are part of the network 108. Such one or more microprocessors or computers 106 may include instructions providing a secure messaging or a chat module 104 for displaying messages between one or more subjects and the authorized personnel through a GUI 105.

The system 100 also enables aggregation of data and messages or chat between a subject and authorized personnel for identifying trends regarding frequency of use of the nicotine-free smoking cessation or nicotine replacement device over time, cravings, responses to automatic communications or requested communications through chat with authorized personnel and changes over time. The data transmitted to the secure server 102 may be posted to a secure website 107 that is accessible by the one or more authorized microprocessors or computers 106 via the network 108.

Also described herein is a graphical user interface ("GUI") 105 of a smart device according to an example embodiment of the present disclosure. One example described herein is for a GUI located on the App of the subject's smart device. The GUI includes an icon 201 that allows the subject to view or see transmitted data from the nicotine-free smoking cessation or nicotine replacement device used by the subject. Such transmitted data or aggregate data can be displayed, for example, as a table, pie chart, or graph. The GUI also includes an icon 202 allowing access to secure messaging or chat between the subject and authorized personnel, which provides for a dialogue 203 of the GUI as described herein. Further, the GUI of the subject's smart device may include an icon allowing a subject to access a support group messaging or chat module for subjects using the nicotine-free smoking cessation or nicotine replacement device to provide support, encouragement and tips to other subjects for reducing or eliminating the immediate craving or for dealing with future cravings.

Each of the one or more authorized microprocessors or computers 106 which are part of the network 108 also include a GUI that includes an icon 202 allowing authorized personnel access to secure messaging or chat between the subject and authorized personnel, which provides for a dialogue 203 of the GUI on the authorized microprocessor or computer 106 as described herein. The GUI of each of the one or more authorized microprocessors or computers 106 also includes an icon or tab that allows authorized personnel to view or see transmitted data and aggregate data for each subject. Such transmitted data or aggregate data can be displayed, for example, as a table, pie chart, or graph.

Also described herein is a method 300 according to an example embodiment of the present invention. Data from a subject's nicotine-free smoking cessation or nicotine replacement device 301 or a subject's smart device 302 are wirelessly transmitted via said smart device 302 to a secure server 303. If the transmitted data are above a preset or predetermined threshold or range, which may be predetermined or which may be set or overridden by the subject, a preemptive message 304 is sent to the subject's smart device 302 in accordance with the determined schedule. Additional preemptive messages 304 are automatically sent to the subject's smart device based on trends 311 identified in the subject's data transmitted to the secure server 303 periodically over time (e.g., each day, week, month, etc.) and aggregated, in accordance with the determined schedule.

The subject may respond to any such preemptive message requesting more information 305, requesting to chat with authorized personnel 306 or electing to chat with other subjects in the support group 307. In response to each preemptive message, if a subject requests more information, the system provides additional messages with options for more information 308. If a subject selects or requests to chat with authorized personnel, such authorized personnel receive a notification of the request 309 and the subject and the authorized personnel have communications via a secure communication or chat module on the subject's smart device 302 via the subject's App and one of the authorized microprocessors or computers 310 which are part of the network. If a subject requests or selects to chat with other subjects in a support group, the system provides access to such support group chat module 312 via, for example, a link or a tab.

The subject can also monitor his or her progress by selecting to view recently transmitted data 313, historical data 314 or aggregate data 315, displayed, for example, on one or more tabs as a table, pie chart, or graph.

In accordance with the present disclosure, one of skill in the art will appreciate aspects of the present disclosure may be embodied in a system, method, computer program and/or computer program product. Aspects of the present disclosure may take the form of a hardware-only embodiment, an embodiment including one or more microprocessors operating with software (including firmware, resident software, micro-code, etc.) or an embodiment combining software and hardware aspects that may all generally be referred to herein as a "system." Furthermore, aspects of the present disclosure may take the form of a computer program or computer program product embodied in one or more computer readable medium(s) having computer readable program code embodied thereon.

Any combination of one or more computer readable medium(s) may be utilized. The computer readable medium may be a non-transitory computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable com pact disc read-only memory (CD-ROM), an optical storage device, a magnetic storage device, or any suitable combination of the foregoing. In the context of this disclosure, a computer readable storage medium may be any tangible medium that can contain or store a program for use by or in connection with an instruction execution system, apparatus, or device. A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

Computer program code for carrying out operations for aspects of the present invention may be written in any combination of one or more programming languages, including an object-oriented programming language such as Java, Smalltalk, C++, C#, Transact-SQL, XML, PHP or the like and conventional procedural programming languages. Such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Computer program instructions may be provided to a processor of a general purpose computer, special purpose computer, or other programmable data processing apparatus to produce a machine, such that the instructions, which execute with the processor of the computer or other programmable data processing apparatus, create means for implementing the functions/acts specified.

These computer program instructions may also be stored in a computer readable medium that can direct a computer, other programmable data processing apparatus, or other devices to function in a particular manner, such that the instructions stored in the computer readable medium produce an article of manufacture including instructions which implement the functions/acts specified.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified.

Also described herein is a representative hardware environment for practicing at least one embodiment of the invention. The description identified herein provides a hardware configuration of an information handling/computer system in accordance with at least one embodiment of the invention. The system comprises at least one microprocessor or central processing unit (CPU) 106. The one or more microprocessors or computers 106 are interconnected with system bus 410 to various devices such as a random access memory (RAM) 414, read-only memory (ROM) 416, and an input/output (I/O) adapter 418. The I/O adapter 418 can connect to peripheral devices, such as disk units 411 and tape drives 413, or other program storage devices that are readable by the system. The system can read the inventive instructions on the program storage devices and follow these instructions to execute the methodology of at least one embodiment of the invention.

Certain aspects of the disclosure are now explained further via the following non-limiting examples.

EXAMPLES

Example 1: Aerosolization Temperature for Embodiments Using an Electronic Inhaler Device The temperature of aerosolization is directly related to the power in watts running through the atomizer. Below 20 W, the temperature output of the device is from about 25° C. to about 300° C. with no prior usage.

The power in watts (N) can be obtained from the battery voltage (V) and the heating element resistance (R) based on the relationship $W=V^2/R$. For example, the power output for a system having a 4.2 V battery and a resistance of 3 W is 5.9 W (4.22/3). In another example, the power output for a system having a 3.2 V battery and a resistance of 3 W is 3.4

W (3.22/3). In another example, the power output for a system having a 4.2 V battery and a resistance of 1.8 W is 9.8 W (4.22/1.8).

Example 2: Vaporization of a Menthol Formulation Using an Electronic Inhaler Device An electronic inhaler device powered by a 4.2V, 320 mAh lithium-ion battery was used to aerosolize a sample containing menthol solubilized in 0.05% ethyl alcohol and suspended in vegetable glycerin derived from organic palm oil. The sample was heated to between 100° C. to 260° C. with a 3 ohm heating element in about 2 to about 3 second intervals with about 5 to about 10 second rest periods until a total volume of 100 mg was collected. The mixture contained 95% glycerin to which 5% menthol solution in ethyl alcohol (0.05% by volume) was added. A vacuum was used to draw the vapors through the e-inhaler into an impinger, thereby trapping vaporized menthol in a water reservoir present in the impinger. Analysis of the water reservoir in the impinger (HPLC) showed menthol was present. Detection of menthol in the water reservoir confirms that the menthol was vaporized.

Example 3: Vaporization of a Vitamin B12 Formulation

An electronic inhaler device powered by a 4.2V, 320 mAh lithium-ion battery was used to aerosolize a sample containing vitamin B12 in vegetable glycerin and 1,3-propanediol. The sample was heated to between 100° C. to 260° C. with a 3 ohm heating element in about 2 to about 3 second intervals with about 5 to about 10 second rest periods until a total volume of 100 mg was collected. The mixture contained 60% glycerin and 40% 1,3-propanediol to which 2 mg/ml of vitamin B12 was added. A vacuum was used to draw the vapors through the e-inhaler into an impinger, thereby trapping vaporized vitamin B12 in a water reservoir present in the impinger. Analysis of the water reservoir in the impinger (HPLC) showed vitamin B12 was present. Detection of vitamin B12 in the water reservoir confirms that the vitamin B12 was vaporized.

Example 4: Vaporization of a Melatonin Formulation

An electronic inhaler device powered by a 4.2V, 320 mAh lithium-ion battery was used to aerosolize a sample containing melatonin in vegetable glycerin and 1,3-propanediol. The sample was heated to between 100° C. to 260° C. with a 3 ohm heating element in about 2 to about 3 second intervals with about 5 to about 10 second rest periods until a total volume of 100 mg was collected. The mixture contained 60% glycerin and 40% 1,3-propanediol to which 33 mg/ml melatonin was added. A vacuum was used to draw the vapors through the e-inhaler into an impinger, thereby trapping vaporized melatonin in a water reservoir present in the impinger. Analysis of the water reservoir in the impinger (HPLC) showed melatonin was present (FIG. 1(A), (B)). Detection of melatonin in the water reservoir confirms that the melatonin was vaporized.

Example 5: Vaporization of a L-theanine/Caffeine Formulation

Figure 2:
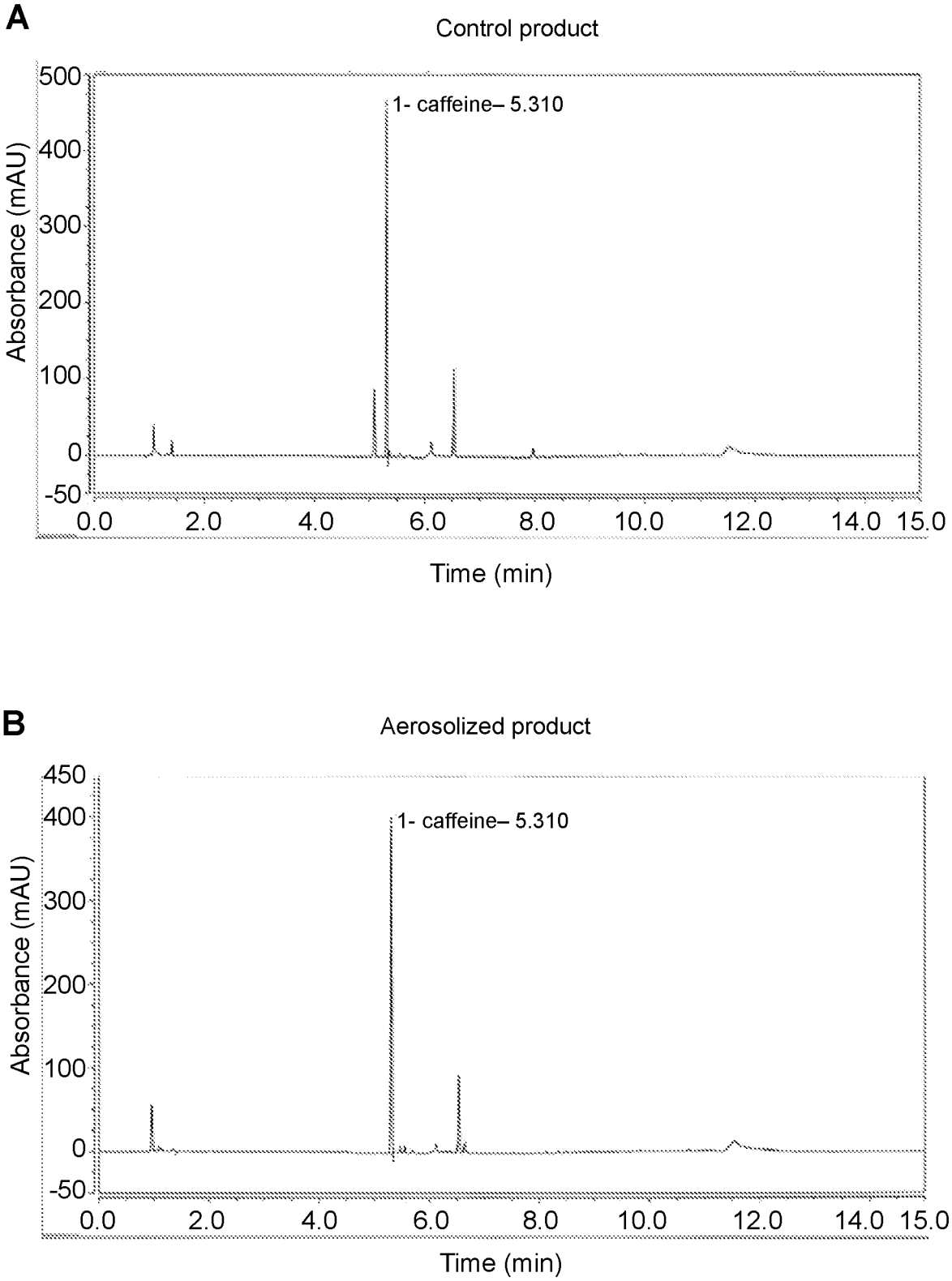
FIG. 2 illustrates that caffeine is present in the aerosolized state. (A) Chromatogram of sample of product containing caffeine prior to vaporization, tested by HPLC. (B) Chromatogram of same sample after vaporization into water reservoir present in the impinger, tested by HPLC. (HPLC Instrument method: C18 pH6 full gradient; Run Time: 15 min; Injection volume: 5 μl; Wavelength: 210.0 nm; Bandwidth: 10; Dilution Factor: 1.0000; Sample weight: 1.0000).
Figure 3:
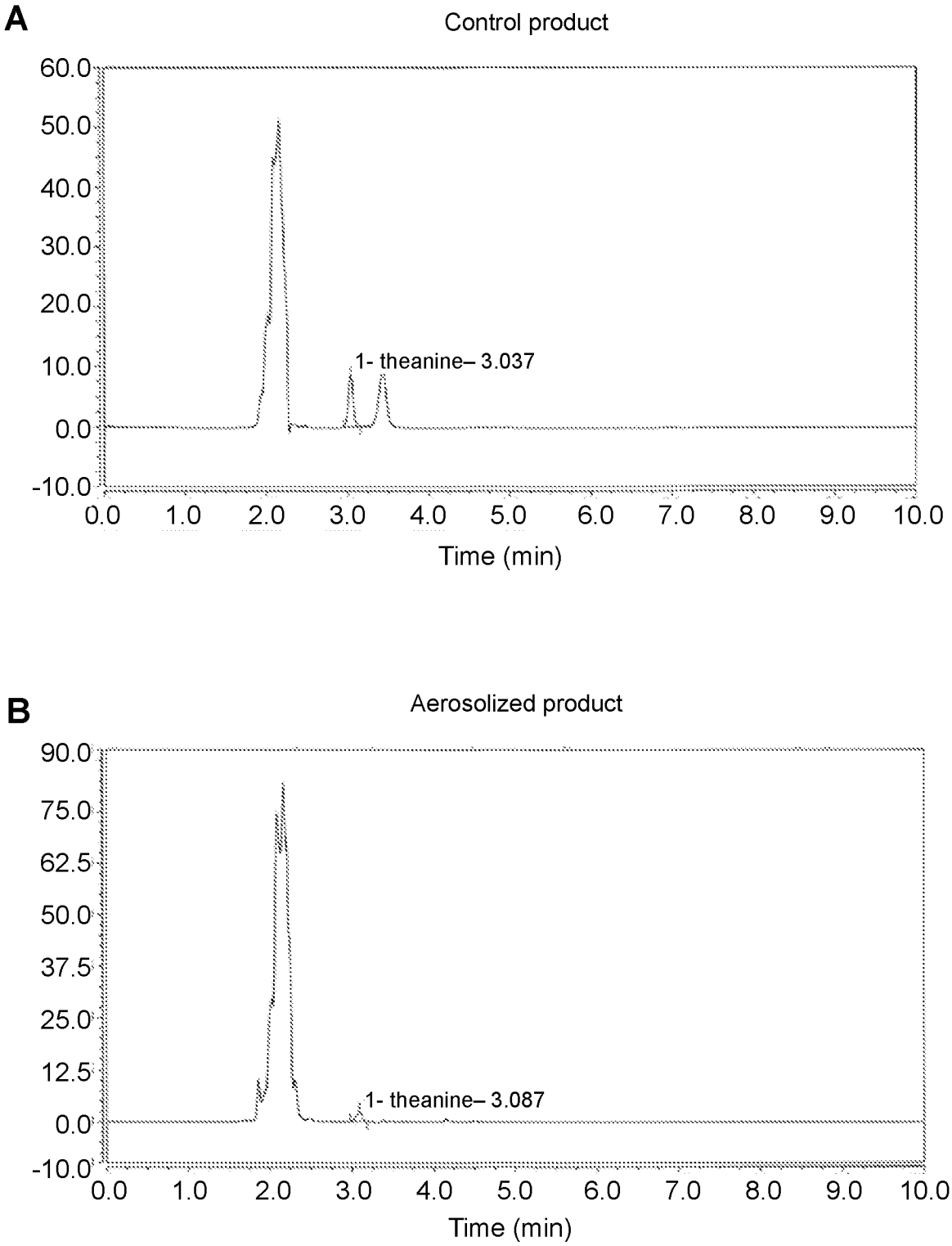
FIG. 3 illustrates that L-theanine is present in the aerosolized state. (A) Chromatogram of sample of product containing L-theanine prior to vaporization, tested by HPLC. (B) Chromatogram of same sample after vaporization into water reservoir present in the impinger, tested by HPLC. (HPLC—Instrument method: HILIC H3PO4 pH6 CAN isocratic; Run Time: 10 min; Injection volume: 5 μl; Wavelength: 210.0 nm; Bandwidth: 10; Dilution Factor: 1.0000; Sample weight: 1.0000).

An electronic inhaler device powered by a 4.2V, 320 mAh lithium-ion battery was used to aerosolize a sample containing L-theanine and caffeine in vegetable glycerin and 1,3-propanediol. The sample was heated to between 100 to 260° C. with a 3 ohm heating element in about 2 to about 3 second intervals with about 5 to about 10 second rest periods until a total volume of 100 mg was collected. The mixture contained 60% glycerin and 40% 1,3-propanediol to which 7.7 mg/ml L-theanine, 4.6 mg/ml caffeine, and 2 mg/ml vitamin B12 was added. A vacuum was used to draw the vapors through the e-inhaler into an impinger, thereby trapping vaporized L-theanine and caffeine in a water reservoir present in the impinger. Analysis of the water reservoir in the impinger (HPLC) showed that both L-theanine and caffeine were present (FIG. 2(A), (B)), and demonstrated similar levels of L-theanine and caffeine as the original samples prior to vaporization (FIG. 3(A), (B)). Detection of L-theanine and caffeine in the water reservoir confirms that both L-theanine and caffeine were vaporized.

Example 6: Vaporization of a B Vitamin Formulation

Figure 4:
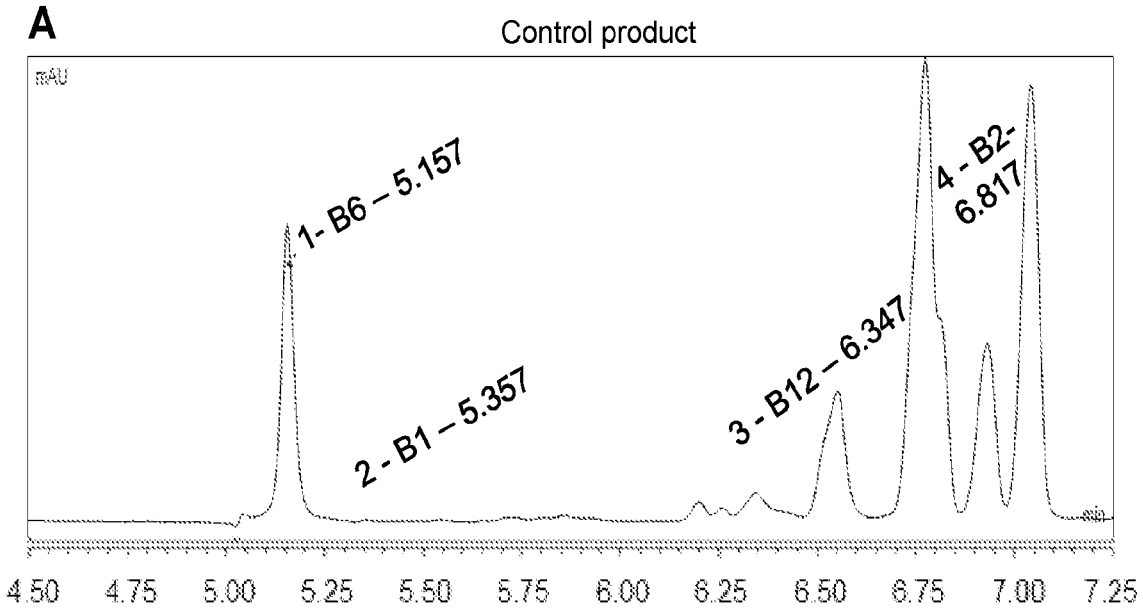
FIG. 4 illustrates that B vitamins are present in the aerosolized state. (A) Chromatogram of control sample containing vitamins B1, B2, B6 and B12 prior to vaporization, tested by HPLC through appropriate protocols to identify the presence of each of the vitamins. (B) Chromatogram of same sample after vaporization into water reservoir present in the impinger, tested by HPLC.
Figure 4:
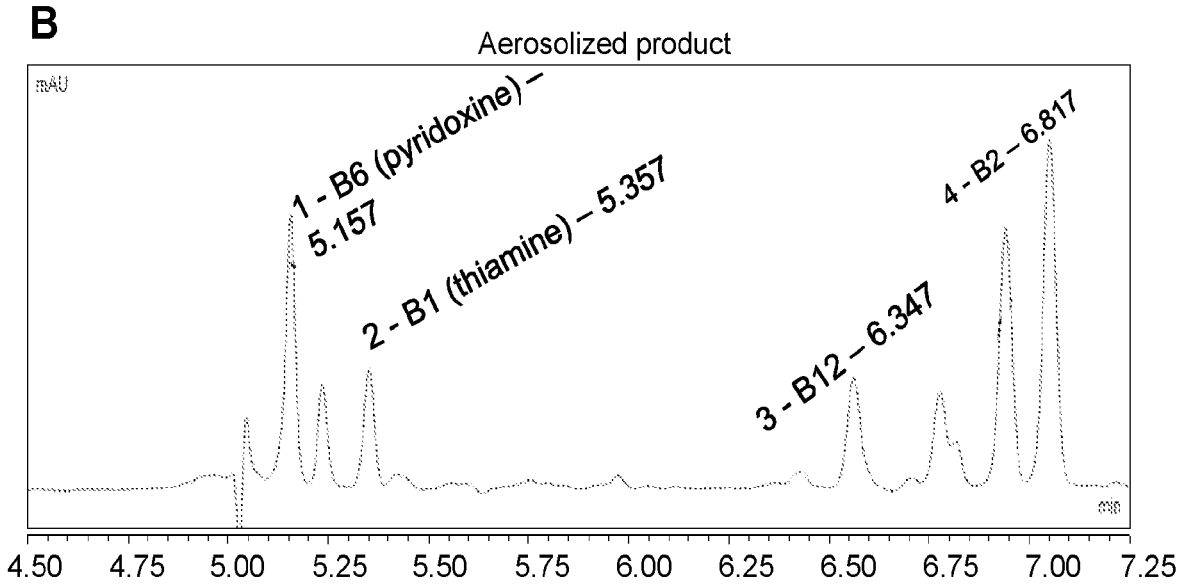

An electronic inhaler device powered by a 4.2V, 320 mAh lithium-ion battery was used to aerosolize a sample containing vitamins B1 (thiamine), B2 (riboflavin), B6 (pyridoxine) and B12 (cobalamin) in vegetable glycerin and 1,3-propanediol. The sample was heated to between 100° C. to 260° C. with a 3 ohm heating element in about 2 to about 3 second intervals with about 5 to about 10 second rest periods until a total volume of 100 mg was collected. The mixture contained 60% glycerin and 40% 1,3-propanediol to which vitamins B1 (1.3 mg/ml), B2 (1.3 mg/ml), B6 (2.7 mg/ml) and B12 (2.5 mcg/ml) were added. A vacuum was used to draw the vapors through the e-inhaler into an impinger, thereby trapping vaporized vitamins in a water reservoir present in the impinger. Analysis of the water reservoir in the impinger (HPLC) showed vitamins B1, B2, B6 and B12 were present (FIG. 4(B)), and demonstrated similar levels of each of vitamins B1, B2, B6 and B12 in vapor, as compared with the original sample of liquid vitamin formula prior to vaporization (FIG. 4(A)). Detection of each of these vitamins in the water reservoir confirms that vitamins B1, B2, B6 and B12 were vaporized.

Example 7: Quality Control Studies of Vaporization Products

Following the successful phase shift tests, a Quality Control Analysis was completed to detect chemical components and to eliminate any undesirable substances. Undesirable substances include nicotine, diacetyl, acetoin and pentanedione. The analysis was conducted on the samples utilizing both HPLC and gas chromatography+mass spectroscopy (GCMS). Zero undesirable or volatile substances were detected, as shown in Table 3. Propylene Glycol (PG), another undesirable substance, is also not present or detected in the vaporized compositions (data not shown).

TABLE 3

Quality Control Analysis of Vitamin Vapor.

| Component | Concentration (μg/g) |
|---|---|
| Diacetyl | ND < 2 |
| Pentanedione | ND < 2 |
| Acetoin | ND < 11 |
| Nicotine | ND < 30 |

ND: Not detected

Example 8: In Vivo Efficacy of a Vaporized Menthol Formulation Using an Electronic Inhaler Device An electronic inhaler device powered by a 4.2V, 320 mAh lithium-ion battery was used to aerosolize a sample containing menthol solubilized in ethyl alcohol (0.05% by volume) and added to organic vegetable glycerin. The aerosolized sample was inhaled by test subjects. The sample was heated to between 75 to 260° C. with a 3 ohm heating element in about 2 to about 3 second intervals with about 5 to about 10 second rest periods for a total of about 90 minutes. The mixture contained 95% glycerin to which 5% methanol solution in ethyl alcohol (0.05% by volume) was added.

Figure 5:
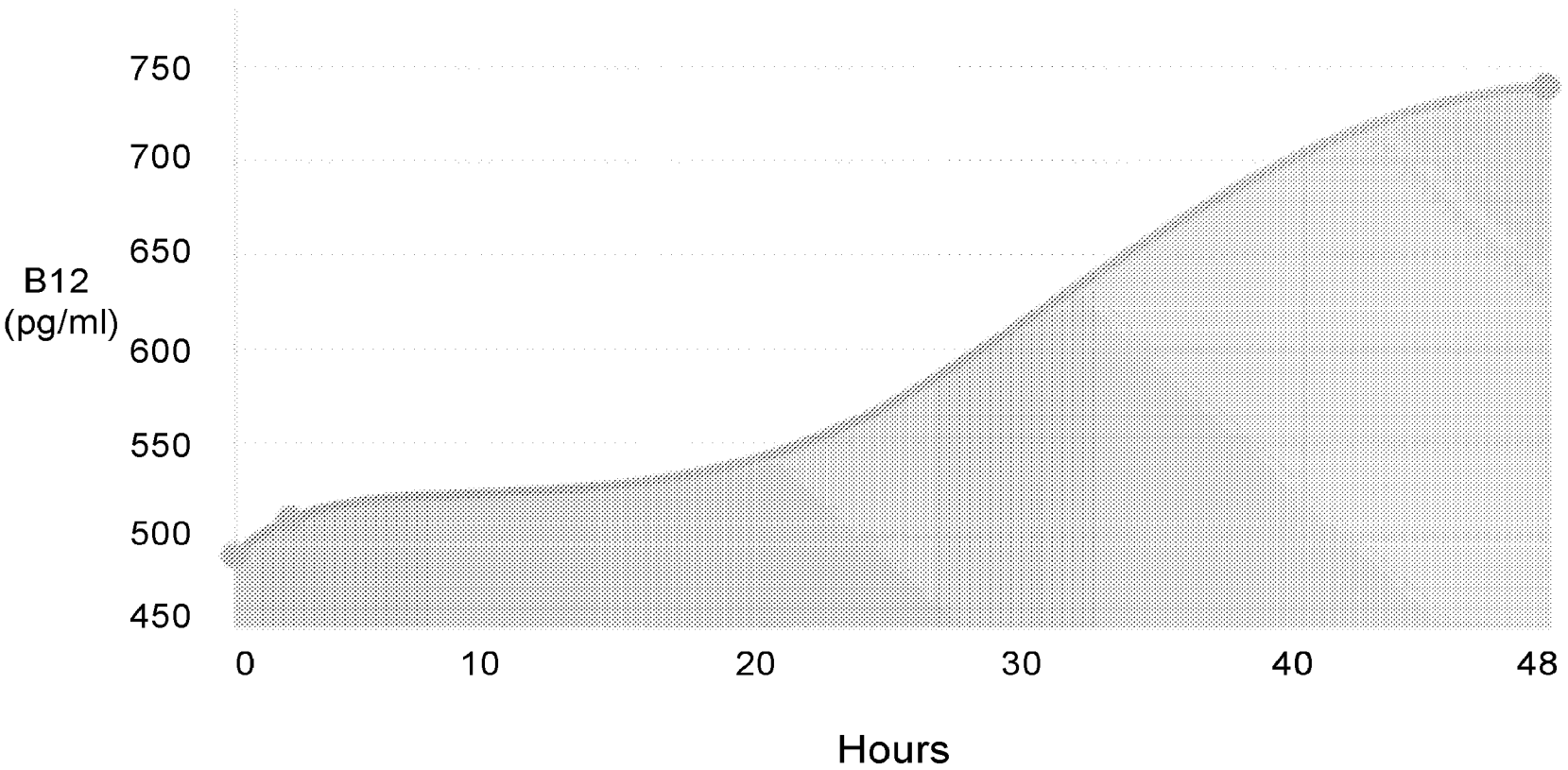
FIG. 5 illustrates an increase in Vitamin B12 blood serum levels from in vivo studies. Three doses (60 inhalations/dose) of vitamin B12 product (20 mg/ml) taken in 24 hour intervals; serum vitamin B12 levels measured at time zero, prior to initial dose and 2 hours after inhalation of first and third doses.

Example 9: Sustained Serum Level Increase with Use of a Vaporized Vitamin Formulation An electronic inhaler device powered by a 4.2V, 320 mAh lithium-ion battery was used to aerosolize a sample containing vitamin B12 in organic vegetable glycerin and 1,3-propanediol and the aerosolized sample was inhaled by one test subject. The sample was heated to between 75° C. to 260° C. with a 3 ohm heating element in about 2 to about 3 second intervals with about 5 to about 10 second rest periods for a total of about 90 minutes. The mixture contained 60% glycerin and 40% 1,3-propanediol to which 2 mg/ml vitamin B12 was added. Test subject took 60 inhalations/breaths (one dose) of the vitamin B12 product (20 mg/ml) per day for 3 consecutive days. Each of the three doses was administered at 24 hour intervals. Serum vitamin B12 levels were measured in the test subject before inhalation of the aerosolized sample and 2 hours after inhalation of the initial and final dose of the aerosolized sample. Before inhalation, serum B12 levels averaged 496.0 pg/ml. Two hours after inhalation of the initial dose, serum B12 levels averaged 517.0 pg/ml, and two hours after the final dose, serum B12 levels averaged 728.0 pg/ml (FIG. 5). A human subject is deficient of vitamin B12 when blood serum levels are below 200 pg/ml. Continued use of the vitamin B12 product over a 48 hour period increased B12 blood serum levels by 232 pg/ml. This study demonstrates that the aerosolized vitamin B12 product increases B12 blood levels when inhaled by a test subject.

It is understood that the examples and embodiments described herein are for illustrative purposes only and that various modifications or changes in light thereof will be suggested to persons skilled in the art and are to be incorporated within the spirit and purview of this application and scope of the appended claims. All publications, patents, and patent applications cited herein are hereby incorporated herein by reference for all purposes.

The corresponding structures, materials, acts, and equivalents of all means plus function elements in the claims are intended to include any structure, or material, for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are Suited to the particular use contemplated.

I claim:

1. An inhalable composition consisting of menthol, alcohol and a carrier, wherein the composition is a liquid, and wherein the menthol is crystalline menthol that is homogenized in alcohol before adding to the carrier, and wherein the alcohol is present at about 0.01% to about 0.15% (w/v), wherein said menthol constitutes about 5% to about 20% by weight, based on the total weight of the inhalable liquid composition, said composition being nicotine-free.

2. The inhalable composition according to claim 1, wherein the carrier is selected from the group consisting of glycerin, 1,3-propanediol, and combinations thereof.

3. The inhalable composition according to claim 1, wherein the carrier comprises glycerin and 1,3-propanediol present in a weight ratio of 1:1000 to 1000:1.

* * * * *